US009058745B2

(12) United States Patent
Leyden

(10) Patent No.: US 9,058,745 B2
(45) Date of Patent: Jun. 16, 2015

(54) SYSTEM FOR FACILITATING TRAFFIC FLOW WITHIN A SPACE

(75) Inventor: Roger J. Leyden, Inverness, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 563 days.

(21) Appl. No.: 13/018,895

(22) Filed: Feb. 1, 2011

(65) Prior Publication Data

US 2012/0195029 A1 Aug. 2, 2012

(51) Int. Cl.
*F21V 33/00* (2006.01)
*G08G 1/16* (2006.01)
*G08G 1/095* (2006.01)

(52) U.S. Cl.
CPC ..... *G08G 1/164* (2013.01); *G08G 1/095* (2013.01)

(58) Field of Classification Search
USPC ..... 362/135, 140
See application file for complete search history.

(56) References Cited

U.S. PATENT DOCUMENTS 6,382,802 B1 * 5/2002 Goodman ..... 359/840
6,424,377 B1 * 7/2002 Driscoll et al. ..... 348/335
6,601,971 B1 * 8/2003 Ko ..... 362/219
7,086,750 B2 8/2006 Leyden et al.
8,356,908 B1 * 1/2013 Zadro ..... 362/136
2005/0047158 A1 * 3/2005 Koehler ..... 362/487
2007/0268685 A1 * 11/2007 Fossier et al. ..... 362/135

OTHER PUBLICATIONS

"Domes & Mirrors by Se-Kure", Rev. May 21, 2008, SCI9717, color brochure.

* cited by examiner

*Primary Examiner* — Sean Gramling
(74) *Attorney, Agent, or Firm* — Wood, Phillips, Katz, Clark & Mortimer

(57) ABSTRACT

A system for facilitating vehicular and/or foot traffic movement in a space. First and second lane routes are defined within the space for vehicular and/or foot traffic. Traffic moving in the first lane route either crosses the second lane or merges with traffic moving in the second lane route. A mirror system with a reflective surface is operatively situated within the space to allow traffic moving in at least one of the first and second lane routes to view, through the reflective surface on the mirror, traffic moving in the other of the first and second lane routes as the traffic in the at least one of the first and second lane routes approaches or arrives at a crossing or merge location. The mirror system has a source of illumination that generates an extended pattern of light around a portion of the reflective surface.

23 Claims, 3 Drawing Sheets

SYSTEM FOR FACILITATING TRAFFIC FLOW WITHIN A SPACE

BACKGROUND OF THE INVENTION

1. Field of the Invention

This invention relates to mirrors and, more particularly, to a system incorporating such mirrors to facilitate safe and coordinated movement of traffic flow within a space.

2. Background Art

There is a multitude of different environments wherein vehicular traffic is required to be coordinated, as in public parking lots, in industrial parks, within warehouses, etc. In the exemplary parking lot environment, traffic flow routes are often set up so that incoming and/or outgoing vehicles move in crossing patterns. Collision avoidance depends principally upon the skill and caution exercised by the drivers and their ability to follow designated flow patterns while at the same time stopping and coordinating vehicular movement where the flow patterns merge or intersect. Parking garages generally rely upon simple signage to identify flow direction and generally little in the way of accommodation is made for drivers to navigate locations where vehicles are required to merge or cross.

In some businesses, convex mirrors are strategically placed to allow drivers to see other vehicles at locations that are otherwise either blind or partially blind. These mirrors contribute greatly to collision avoidance and also, more importantly, may alert a driver to foot traffic that is common in parking garages, thereby potentially avoiding personal injury. Significantly, these mirrors, in addition to aiding vehicle drivers, allow individuals who are walking in these spaces to identify vehicles moving at or adjacent the same blind locations.

One problem that continues to exist, as in the different facilities where mirrors are employed, is that the mirrors may not be readily identifiable by those walking or driving within a space. The tendency of walkers and drivers in such confined spaces is to focus on their anticipated paths of movement. As a result, they may not even divert their attention quickly enough to any assisting mirrors to allow them to be of any benefit.

The assignee herein has offered convex mirrors with a relatively eye-catching border that is intended to highlight a potentially otherwise non-dominant structure that may not be in the immediate sight line of the walkers and drivers navigating a space. While these colors do avoid, to some extent, the blending of the dominantly silver mirror color into the commonly light walls and ceilings against which they are observed, these colors are, for many, incapable of drawing the attention of walkers and/or drivers away from the sight lines of their immediate route.

The mirror "blending" is particularly a problem in environments wherein walkers and drivers are exposed to either light or dark conditions or changing light conditions. For example, a driver moving up a ramp from a dark space to a roof location where there is natural light may not have enough time for his/her eyes to adjust to identify a mirror at the top of the ramp. As a result, the driver may depend upon his or her ability to directly see a vehicle to avoid collision.

The same eye adjustment problems are also existent when a driver enters a garage and experiences a significant light change in the transition. For example, at night, an individual may drive into a parking garage that is brightly lit. It may take a significant amount of time for the eyes of the individual to adjust to this increased lighting. As a practical matter, few individuals will stop or slow down to adapt to the changed lighting conditions before proceeding. Thus, they may not even become aware of the presence of assisting mirrors to realize any benefit therefrom.

Generally, safety mirrors are used in spaces that are confined and where individuals must make careful and quick decisions to avoid collisions between vehicles and contact between vehicles and walkers. In spite of the fact that safety mirrors have had the limitations noted above for many decades, those overseeing the various facilities wherein the above problems exist continue to contend with those problems because no viable commercial solutions have been devised to date. Those responsible for safe coordination of foot and vehicular traffic in parking facilities, and the like, continue to seek out better systems, particularly in spaces where personal injury is a possibility.

SUMMARY OF THE INVENTION

In one form, the invention is directed to a system for facilitating vehicular and/or foot traffic movement in a space. The system has first and second lane routes within the space for vehicular and/or foot traffic. The first lane route extends from a first location to a second location, and the second lane route extends from a third location to a fourth location. Traffic moving in the first lane route either crosses the second lane route or merges with traffic moving in the second lane route at a fifth location. A mirror system with a reflective surface within the space allows traffic moving in at least one of the first and second lane routes to view, through the reflective surface on the mirror, traffic moving in the other of the first and second lane routes as the traffic in the at least one of the first and second lane routes approaches or arrives at the fifth location. The mirror system includes a source of illumination that generates an extended pattern of light around a portion of the reflective surface that alerts traffic moving in the at least one of the first and second lane routes to the presence of the mirror system as traffic moving in the at least one of the first and second lane routes approaches or arrives at the fifth location.

In one form, the reflective surface on the mirror system has a convex shape.

In one form, the extended pattern of light extends substantially continuously around a portion of the reflective surface.

In one form, the reflective surface has a parabolic shape with a base and an apex and the light extends around the base.

In one form, the mirror system has a body that defines a parabolic shape with an inside surface and an outside surface, the inside surface bounding a cavity within which the illumination source resides.

In one form, the source of illumination projects light through the body.

In one form, the body has a coating that defines the reflective surface and at least a portion of the body is translucent to allow light from the illumination source to project therethrough.

In one form, the translucent portion of the body has an annular shape.

In one form, the translucent portion of the body has a high visibility color through which the light from the illumination source projects.

In one form, the translucent portion of the body has at least two colors that alternate around the annular shape.

In one form, the body has a continuous piece over the reflective surface and the translucent portion of the body.

In one form, the illumination source is programmed to automatically turn on and off.

In one form, the mirror system has a proximity sensor that detects approaching traffic and causes the illumination source to be turned on.

In one form, the illumination source is programmed to be turned on and off at predetermined intervals.

In one form, the system is incorporated into a parking garage.

In one form, the system is incorporated into a warehouse.

In one form, the illumination source consists of a plurality of LEDs.

In one form, the mirror system includes a body that has a convex shape for the reflective surface and inside and outside surfaces. The LEDs in the plurality of LEDs are joined to a support in a flexible rope form that is applied at the inside surface of the body.

In one form, the space has a wall system and a ceiling and the mirror system is attached to at least one of the wall system and the ceiling.

In one form, the space has a floor, over at least a part of which traffic within the space moves, and the mirror system is supported upon the floor.

DETAILED DESCRIPTION OF THE PREFERRED EMBODIMENT

Figure 1:
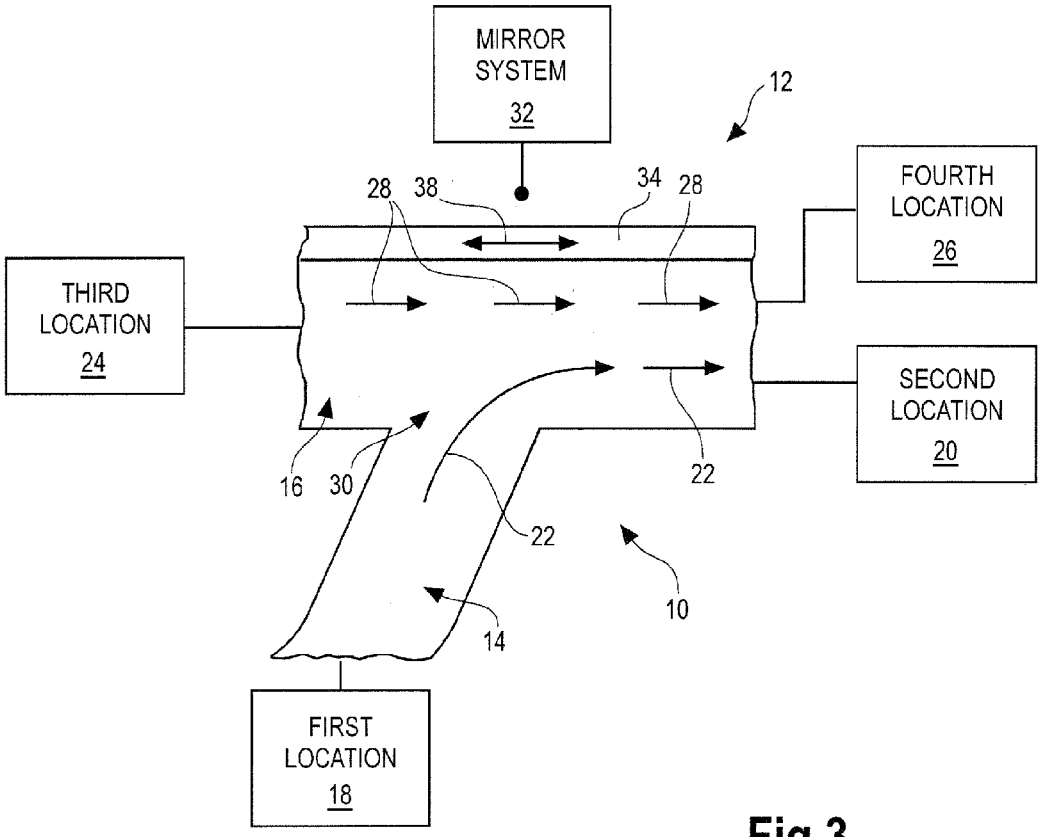
FIG. 1 is a schematic representation of a system for facilitating vehicular and/or foot traffic in a space, according to the invention, including a traffic merging location.

In FIG. 1, a system for facilitating vehicular and/or foot traffic movement in a space 10, according to the present invention, is shown at 12. The system 12 is shown with first and second lane routes 14, 16 within the space 10 for vehicular and/or foot traffic.

The first lane route 14 extends from a first location 18 to a second location 20, with traffic moving therebetween in the direction of the arrows 22.

The second lane route 16 extends from a third location 24 to a fourth location 26, with traffic moving therebetween in the direction of the arrows 28. The second and fourth locations 20, 26 may be the same or different locations.

With the configuration depicted, traffic moving in the first and second lane routes 14, 16 merges at a fifth location at 30. Traffic moving in the first lane route 14 may be unable to see traffic moving in the second lane route 16 until the vehicles and/or individuals are in close proximity to the fifth, merging location 30. Similarly, traffic moving in the second lane route 16 may be unable to view the traffic moving in the first lane route 14 until the vehicle and/or individual arrives at or approaches the fifth, merge location 30.

According to the invention, a mirror system 32 is provided within the space 10 to allow traffic moving in at least one of the first and second lane routes 14, 16 to view traffic moving in the other of the first and second lane routes 14, 16 as the traffic in the at least one of the first and second lane routes 14, 16 approaches or arrives at the fifth location 30. Preferably, the mirror system 32 allows viewing by traffic, moving in each of the first and second routes 14, 16, of traffic moving in the other of the first and second routes 14, 16.

Figure 2:
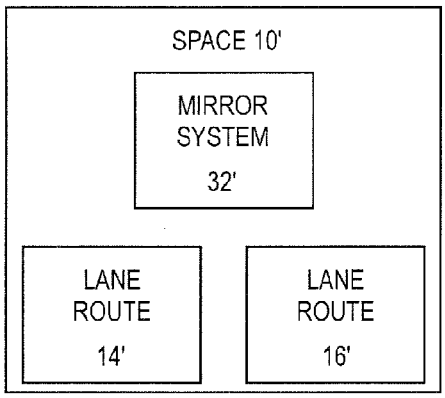
FIG. 2 is a further schematic representation of a system as in FIG. 1 and intended to encompass other space configurations.

It should also be understood that the nature of the space is not critical to the present invention. As depicted in FIG. 2, the invention contemplates incorporation of the mirror system 32' into virtually any space 10' having lane routes 14', 16' wherein traffic moving within the lane routes 14', 16' is required to merge or cross. The space 10' might be, for example, a parking garage, a warehouse, etc. The mirror system 32' facilitates viewing of traffic moving in at least one of the lane routes 14', 16' by traffic moving in the other of the lane routes 14', 16'.

In FIG. 1, a further aspect is shown wherein a separate lane route 34 is provided upon which foot traffic might move selectively in opposite directions, as indicated by the double-headed arrow 38, parallel to or crossing one of the lane routes 14, 16.

Figure 3:
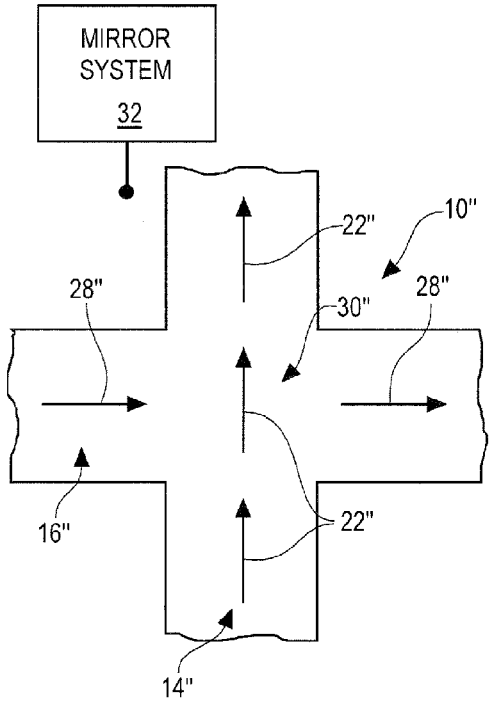
FIG. 3 is a view as in FIG. 1 and showing a space with a traffic crossing location.

FIG. 3 depicts a space 10" with first and second lane routes 14", 16" within which traffic moves respectively in the direction of the arrows 22", 28". Traffic moving in the intended directions within the routes 14", 16" crosses at the location 30".

Generally, the configuration of the space will dictate an obvious traffic flow pattern. The intended flow pattern may be further established by conventional signage throughout the space.

The mirror system 32 is incorporated to facilitate viewing by traffic moving in either, and preferably each, of the first and second lane routes 14", 16", of the traffic moving in the other of the first and second lane routes 14", 16" as the crossing location 30" is approached.

The spaces 10, 10" shown in FIGS. 1 and 3 are but exemplary of the multitude of different space/traffic flow configurations contemplated within the generic disclosure of FIG. 2. The spaces 10' may be indoors or outdoors or partially indoors and outdoors. The merging and crossing locations may be where ramps and/or level surfaces meet other ramps and/or level surfaces. The space may be lighted naturally or with generated light. Alternatively, the space may be partially lit naturally and partially using generated light from a strategically spaced source or series of sources.

Figure 4:
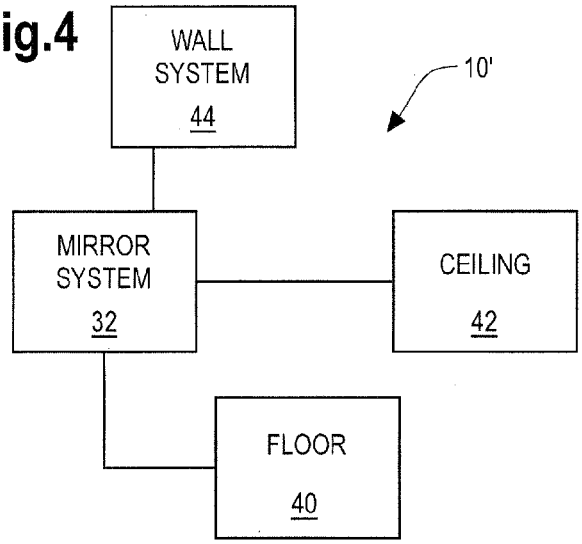
FIG. 4 is a schematic representation of a mirror system, according to the invention, with alternative mount/support structures therefor.

As shown in FIG. 4, the mirror system 32 may be supported/mounted using any of three cooperating structures. The mirror system 32 may be supported on a floor 40, ceiling 42, and/or a wall system 44 within the space 10'. The particular construction within the space 10' dictates the most appropriate structure for mounting/supporting the mirror system 32.

Figure 5:
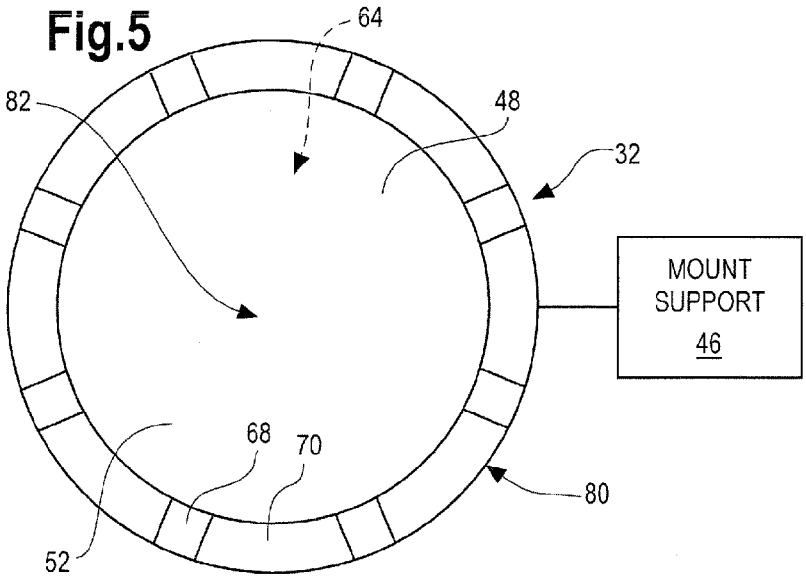
FIG. 5 is a front elevation view of one form of mirror system as shown in FIGS. 1-4.
Figure 6:
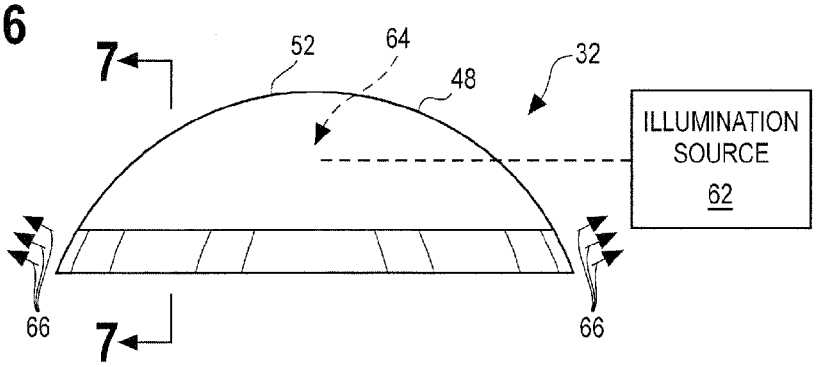
FIG. 6 is a plan view of the mirror system in FIG. 5.
Figure 7:
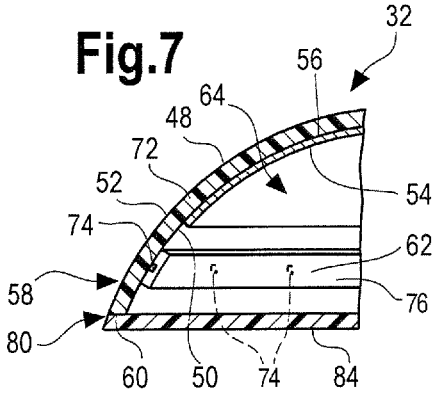
FIG. 7 is a cross-sectional view of the mirror system taken along line 7-7 of FIG. 6.

One exemplary form of the mirror system 32 is shown in FIGS. 5-7. The mirror system 32 is operatively positioned upon a mount/support 46 through any of the floor 40, ceiling 42, and/or wall system 44. The precise structure of the mount/support 46 is not critical to the present invention and virtually an unlimited number of different suitable mounts/supports 46 could be devised by those skilled in the art.

The mirror system 32 consists of a body 48 that has a truncated spherical, or parabolic, shape. The precise shape of the body 48 is not critical to the present invention, but preferably a convex reflective surface, as hereinafter described, is defined to allow for angled viewing of a reflected image.

The body 48 has an inside surface 50 and an outside surface 52. In one form, the body 48 is made from a translucent material, such as plastic. A reflective coating 54 is applied strategically over the inside surface 50 of the body 48 to define a reflective surface 56 on the body 48, corresponding in shape to the body 48 at the applied location, to substantially fully block transmission of light in an inside-to-outside direction. The body 48 may be made according to any of the constructions disclosed in U.S. Pat. No. 7,086,750, the disclosure of which is incorporated herein by reference.

A portion 58 of the body 48, in this case adjacent to a free body edge 60, remains free of the reflective coating 54 whereby light from an illumination source 62 can be projected from within a cavity 64, bounded by the body 48, to externally thereof, as indicated by the arrows 66. In this embodiment, the portion 58 has an annular shape fully around the body 48, adjacent to the edge 60. The annular shape projects a substantially constant distance from the edge 60 over its entire extent.

In one preferred form, the portion 58 is colored with selection preferably of a high visibility color. For example, the color may be red, orange, yellow, green, etc. which are generally recognized as being high visibility colors. A mix of these colors is also desirable to make the portion 58 eye catching. In the depicted embodiment, alternating annular lengths 68, 70 have different colors, again to make the portion 58 stand out as much as possible. As one example, and in a preferred form, the alternating colors are yellow and black. Whereas the black color may not transmit light at all, or may transmit light to a limited extent, the contrasting yellow and black makes the portion more prominently viewable as the mirror system 32 is approached.

In one form, a continuous piece 72 is made, as by molding, to define the body 48, including the inside surface 50, over which the reflective coating 54 is placed, and the translucent portion 58.

In this embodiment, the illumination source 62 is shown to be made up of a plurality of LEDs 74 joined to a support 76 in a flexible rope form that is applied at the inside surface 50 of the body 48.

While it is not required that individual LEDs 74 be utilized, it is desirable that the source of illumination 62 generate an extended pattern of light that produces a partial or full framing effect that highlights the presence of the mirror system 32 and the reflective surface 56 that is part thereof. As a result, from a relatively significant distance, the generated light alerts oncoming traffic to the presence of the mirror system 32, significantly in advance of the merging/intersecting location, whereby the individual walking or driving can focus early upon the mirror system 32 to thereby observe traffic movement and take appropriate precautions. The mere presence of the lighted mirror system 32 prepares the individual on foot or in a vehicle that a potentially dangerous location within the space is near, whereby a user may adjust his/her speed and change his/her focus towards the mirror system 32 that will facilitate early viewing of potentially conflicting traffic.

Figure 8:
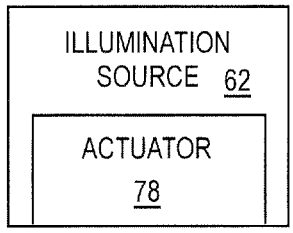
FIG. 8 is a schematic representation of the illumination source on the mirror system in FIGS. 5-7 and showing an actuator therefor.

To make the mirror system more prominent and detectable, different types of actuators 78 may be incorporated into the illumination source 62, as shown in FIG. 8. The actuator 78 may be located in the cavity 64 and programmed to automatically turn the illumination source 62 on and off at regular intervals in a flashing pattern. The intervals may be relatively short, whereby an individual will treat this signaling consistent with signaling as on public streets that induces an individual to use an extra level of caution.

Alternatively, the actuator 78 may be a proximity sensor incorporated to detect approaching traffic and cause the illumination source to be turned on at a particular distance interval. Again, this makes the mirror system 32 more eye-catching to more positively announce to those in the vicinity thereof that there is a situation that demands caution.

As noted above, the alerting function is most effective with the light projecting in an extended pattern that may be continuous or with gaps that are such that the projecting light gives the effect of framing or partial framing of the reflective surface 56. With the body 48 shown, the reflective portion 58 frames substantially the entire reflective surface 56 by being continuous at a base 80 on the body 48 that is remote from the apex 82. The reflective surface 56 blocks light transmission through the body 48 in a region between the base 80 and apex 82.

With the inventive concepts in hand, one skilled in the art can adapt a mirror system 32 to be most effectively displayed in the appropriate space 10', be it a parking garage, a warehouse, or other space within which vehicular and/or foot traffic moves in merging or intersecting routes.

An optional wall 84 may be provided to bridge the base edge 60, as to enclose the cavity 64 and potentially facilitate mounting to the appropriate structure to place the mirror system 32 in the operative position therefor.

Figure 9:
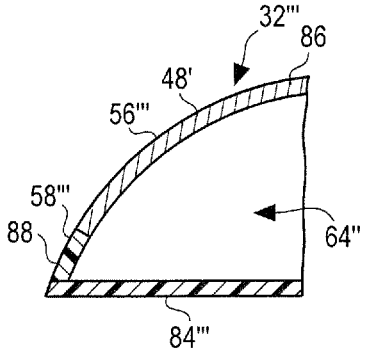
FIG. 9 is a view as in FIG. 7 of a modified form of mirror system.

It should be understood that those skilled in the art can devise numerous modifications from the embodiment shown in FIGS. 5-9 without departing from the invention. For example, as shown in FIG. 9, which corresponds to the view in FIG. 6, the body 48' may be made with a metallic component 86 such as reflective metal that can be polished to produce the reflecting surface 56''' to substantially fully block transmission of light in an inside-to-outside direction. A separate piece 88 may be joined to the metallic component 86 to produce the translucent portion 58'''. An optional wall 84''' closes the cavity 64''' and may potentially be used to assist mounting/support for the mirror system 32''', as shown in FIG. 9.

Figure 10:
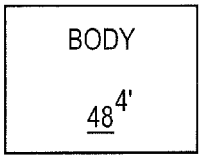
FIG. 10 is a schematic representation of a body as used on the mirror systems in FIGS. 5-9.

In FIG. 10, a generic form of the body $\mathbf{48}^{4'}$ is shown to encompass not only the shape shown in FIGS. 5-7, but other convex shapes that might be used to view a reflected image from a transverse location. The shape of the body $\mathbf{48}^{4'}$ contemplated is any one that allows angled viewing of a reflected image, be it at a corner, in a flat wall, etc.

Figure 11:
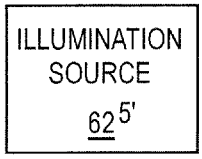
FIG. 11 is a schematic representation of an illumination source, as used in the mirror systems in FIGS. 5-9.

Further, as shown in FIG. 11, the illumination source $\mathbf{62}^{5'}$ depicted therein is intended to encompass virtually any type of structure that will generate light that can be projected through a translucent surface. This may be in the form of one or more LEDs. Alternatively, bulbs having different shapes might be utilized.

The foregoing disclosure of specific embodiments is intended to be illustrative of the broad concepts comprehended by the invention.

The invention claimed is:

1. A system for facilitating vehicular and/or foot traffic movement in a space, the system comprising:

first and second lane routes within the space for vehicular and/or foot traffic, the first lane route extending from a first location to a second location with the second lane route extending from a third location to a fourth location, traffic moving in the first lane route one of crossing the second lane route or merging with traffic moving in the second lane route at a fifth location; and a mirror system with a reflective surface within the space to allow traffic moving in at least one of the first and second lane routes to view through the reflective surface on the mirror traffic moving in the other of the first and second lane routes as the traffic in the at least one of the first and second lane routes approaches or arrives at the fifth location, the mirror system comprising a source of illumination that generates an extended pattern of light around a portion of the reflective surface that alerts traffic moving in the at least one of the first and second lane routes to the presence of the mirror system as traffic moving in the at least one of the first and second lane routes approaches or arrives at the fifth location, wherein the mirror system has a convex shape with an inside surface, a convex outside surface, a base and an apex, with the pattern of light located at the base in a discrete curved pattern extending around the base, the reflective surface fully blocking light transmission through the convex shape in a direction from the inside surface to the outside surface in a region between the base and apex.

2. The system for facilitating vehicular and/or foot traffic movement according to claim 1 wherein the extended pattern of light extends substantially continuously around a portion of the reflective surface.

3. The system for facilitating vehicular and/or foot traffic movement according to claim 1 wherein the reflective surface has a parabolic shape and the extended pattern of light is generated without projecting through the reflective surface.

4. The system for facilitating vehicular and/or foot traffic movement according to claim 3 wherein the mirror system comprises a body that defines the parabolic shape, the inside surface bounding a cavity within which the illumination source resides.

5. The system for facilitating vehicular and/or foot traffic movement according to claim 4 wherein the source of illumination projects light through the body.

6. The system for facilitating vehicular and/or foot traffic movement according to claim 5 wherein the body comprises a coating that defines the reflective surface and a portion of the body is translucent without the coating thereon to allow light from the illumination source to project therethrough at the base.

7. The system for facilitating vehicular and/or foot traffic movement according to claim 1 wherein the illumination source is programmed to automatically turn on and off.

8. The system for facilitating vehicular and/or foot traffic movement according to claim 7 wherein the mirror system comprises a proximity sensor that detects approaching traffic and causes the illumination source to be turned on.

9. The system for facilitating vehicular and/or foot traffic movement according to claim 7 wherein the illumination source is programmed to be turned on and off at predetermined intervals.

10. The system for facilitating vehicular and/or foot traffic movement according to claim 1 wherein the system is incorporated into a parking garage.

11. The system for facilitating vehicular and/or foot traffic movement according to claim 1 wherein the system is incorporated into a warehouse.

12. The system for facilitating vehicular and/or foot traffic movement according to claim 2 wherein the illumination source comprises a plurality of LEDs.

13. The system for facilitating vehicular and/or foot traffic movement according to claim 12 wherein the mirror system comprises a body that has a convex shape for the reflective surface and inside and outside surfaces, the LEDs in the plurality of LEDs are joined to a support in a flexible rope form that is applied at the inside surface of the body.

14. The system for facilitating vehicular and/or foot traffic movement according to claim 1 wherein the space has a wall system and a ceiling and the mirror system is attached to at least one of the wall system and the ceiling.

15. The system for facilitating vehicular and/or foot traffic movement according to claim 1 wherein the space has a floor over at least a part of which traffic within the space moves and the mirror system is supported upon the floor.

16. A system for facilitating vehicular and/or foot traffic movement in a space, the system comprising:

first and second lane routes within the space for vehicular and/or foot traffic, the first lane route extending from a first location to a second location with the second lane route extending from a third location to a fourth location, traffic moving in the first lane route one of crossing the second lane route or merging with traffic moving in the second lane route at a fifth location; and a mirror system with a reflective surface within the space to allow traffic moving in at least one of the first and second lane routes to view through the reflective surface on the mirror traffic moving in the other of the first and second lane routes as the traffic in the at least one of the first and second lane routes approaches or arrives at the fifth location, the mirror system comprising a source of illumination that generates an extended pattern of light around a portion of the reflective surface that alerts traffic moving in the at least one of the first and second lane routes to the presence of the mirror system as traffic moving in the at least one of the first and second lane routes approaches or arrives at the fifth location, wherein the mirror system has a convex shape with a base and an apex, with the pattern of light located at the base in a discrete curved pattern extending around the base, wherein the reflective surface has a parabolic shape and the extended pattern of light is generated without projecting through the reflective surface, wherein the mirror system comprises a body that defines the parabolic shape with an inside surface and an outside surface, the inside surface bounding a cavity within which the illumination source resides, wherein the source of illumination projects light through the body, wherein the body comprises a coating that defines the reflective surface and a portion of the body is translucent without the coating thereon to allow light from the illumination source to project therethrough at the base, the reflective surface fully blocking light transmission through the convex shape in a direction from the inside surface to the outside surface in a region between the base and apex, wherein the translucent portion of the body has a discrete annular shape, the body has a front and rear and the translucent annular shape defines a rearmost portion of the body.

17. The system for facilitating vehicular and/or foot traffic movement according to claim 16 wherein the translucent portion of the body has a high visibility color through which the light from the illumination source projects.

18. The system for facilitating vehicular and/or foot traffic movement according to claim 17 wherein the portion of the body has at least two colors that alternate around the annular shape.

19. The system for facilitating vehicular and/or foot traffic movement according to claim 16 wherein the body has a continuous piece over the reflective surface and the translucent portion of the body.

20. The system for facilitating vehicular and/or foot traffic movement according to claim 16 wherein the annular shape projects a substantially constant distance from the rearmost portion of the body over an entire extent of the annular shape.

21. A system for facilitating vehicular and/or foot traffic movement in a space, the system comprising:

first and second lane routes within the space for vehicular and/or foot traffic, the first lane route extending from a first location to a second location with the second lane route extending from a third location to a fourth location, traffic moving in the first lane route one of crossing the second lane route or merging with traffic moving in the second lane route at a fifth location; and a mirror system with a reflective surface within the space to allow traffic moving in at least one of the first and second lane routes to view through the reflective surface on the mirror traffic moving in the other of the first and second lane routes as the traffic in the at least one of the first and second lane routes approaches or arrives at the fifth location, the mirror system comprising a source of illumination that generates an extended discrete pattern of light around a portion of the reflective surface that alerts traffic moving in the at least one of the first and second lane routes to the presence of the mirror system as traffic moving in the at least one of the first and second lane routes approaches or arrives at the fifth location, wherein the mirror system has a body with a convex shape with an inside surface, an outside surface, a base and an apex, wherein the extended pattern produces a frame located at the base in a curved pattern extending around the base of the mirror system, the body having a translucent portion on a part of the body without a reflective surface that has the convex shape through which light from the illumination source projects to produce the frame, the body having a reflective surface fully blocking light transmission through the convex shape in a direction from the inside surface to the outside surface in a region between the base and apex.

22. The system for facilitating vehicular and/or foot traffic according to claim 21 wherein the extended pattern defines a discrete annular shape.

23. A system for facilitating vehicular and/or foot traffic movement in a space, the system comprising:

first and second lane routes within the space for vehicular and/or foot traffic, the first lane route extending from a first location to a second location with the second lane route extending from a third location to a fourth location, traffic moving in the first lane route one of crossing the second lane route or merging with traffic moving in the second lane route at a fifth location; and a mirror system with a reflective surface within the space to allow traffic moving in at least one of the first and second lane routes to view through the reflective surface on the mirror traffic moving in the other of the first and second lane routes as the traffic in the at least one of the first and second lane routes approaches or arrives at the fifth location, the mirror system comprising a source of illumination that generates an extended discrete pattern of light around a portion of the reflective surface that alerts traffic moving in the at least one of the first and second lane routes to the presence of the mirror system as traffic moving in the at least one of the first and second lane routes approaches or arrives at the fifth location, wherein the mirror system has a convex shape with a base and an apex, wherein the extended pattern produces a frame located at the base in a curved pattern extending around the base of the mirror system, wherein the extended pattern defines a discrete annular shape, wherein a body defines the reflective surface and has an inside and an outside and the reflective surface substantially fully blocks transmission of light in an inside-to-outside direction through the mirror system between the annular shape and the apex.

* * * * *